United States Patent [19]

Hines

[11] Patent Number: 4,782,472

[45] Date of Patent: Nov. 1, 1988

[54] SOLAR CLOCK WITH DIGITAL TIME DISPLAY

[76] Inventor: Stephen P. Hines, 433 N. Jackson St., Glendale, Calif. 91206

[21] Appl. No.: 101,808

[22] Filed: Sep. 28, 1987

[51] Int. Cl.[4] ..... G04B 19/26; G04B 49/00; G04C 19/00

[52] U.S. Cl. ..... 368/15; 368/82; 368/223; 33/270

[58] Field of Search ..... 368/62, 79, 223, 239; 33/270

[56] References Cited

U.S. PATENT DOCUMENTS

| | | | |
|---|---|---|---|
| 3,566,602 | 7/1971 | Bergey et al. | 368/79 |
| 4,152,853 | 5/1979 | Lewis | 368/239 |
| 4,255,864 | 3/1981 | Glendinning | 33/270 |
| 4,279,031 | 7/1981 | Dostoomian | 368/239 |
| 4,384,408 | 5/1983 | Bohlayer | 33/270 |

FOREIGN PATENT DOCUMENTS 2467427 4/1981 France .

*Primary Examiner*—Vit W. Miska
*Attorney, Agent, or Firm*—Warren W. Kurz

[57] ABSTRACT

A solar clock utilizes the sun's radiant energy to illuminate a digital display in accordance with the solar time. An opaque mask member, preferably in the form of a right circular cylinder, is provided with a series of sunlight-transmitting apertures which cooperate with a plurality of strategically positioned fiber optic arrays, operatively coupled to a light-responsive digital display, to provide an indication of the solar time. During the course of travel of the sun across the sky, the sun illuminates different fiber optic arrays through the mask. The fiber optics serve to couple the sun's energy to the digital display.

10 Claims, 5 Drawing Sheets

SOLAR CLOCK WITH DIGITAL TIME DISPLAY

This invention relates to improvements in solar clocks and, more particularly, to a solar clock which utilizes the sun's radiant energy itself to illuminate a digital display to provide an indication of the solar time. In a broader sense, the invention pertains to an optical analog-to-digital converter.

Solar clocks are, by no means, new. Sundials, of course, have been used since ancient times to measure the passage of time. While many improvements have been made over the years to increase the accuracy of such devices, relatively little has been done to facilitate their readout (i.e., their display of time). To date, one must still visually observe the position of the shadow cast by a so-called "gnomon" on an analog scale and interpolate the time between the scale readings. This not only requires the physical presence of the observer at the instrument, but also requires a certain amount of skill by the observer in understanding the instrument.

SUMMARY OF THE INVENTION

In view of the foregoing, an object of this invention is to provide a solar clock which is improved from the standpoint that the sun's rays cause the time to be displayed in a readily comprehensible digital form at virtually any location desired.

Another object of this invention is to provide an optical apparatus for converting the analog movement of a light source to a digital form.

The solar clock (and optical analog-to-digital converting apparatus) of the invention basically comprises the combination of (a) an opaque mask member having a plurality of spaced, light-transmitting apertures of predetermined size, shape and relative position; (b) a plurality of spaced arrays of optical light guides, each array being arranged with respect to certain of such apertures to be irradiated by radiation emanating from a moving source of radiation (e.g. the sun) and passing through such apertures; and (c) digital display means, operatively coupled to the light guides and adapted to display the instantaneous position of the source in digital form, depending on which of the light guides are irradiated, at a given time, by the source.

The invention will be better understood from the ensuing detailed description of preferred embodiments, reference being made to the accompanying drawings.

DETAILED DESCRIPTION OF A PREFERRED EMBODIMENT

Figure 1:
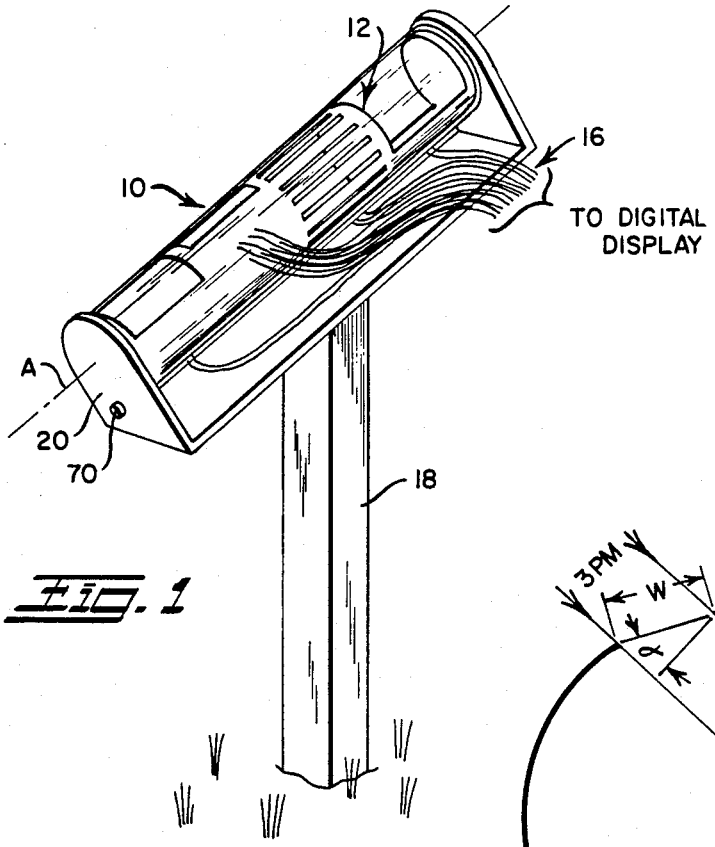
FIG. 1 is a perspective view of a solar clock structured in accordance with a preferred embodiment of the invention.

Referring now to the drawings, FIG. 1 depicts a solar clock 10 embodying the present invention. Such clock basically comprises a mask member 12, digital display means 14 (see FIG. 2) and a plurality of optical light guides 16, such as conventional strands of optical fibers, for optically coupling solar radiation, passing through certain apertures in the mask member, to the digital display. As will be explained below, the display means is illuminated only by solar energy transmitted by the light guides, that is, it is not electrically energized. The clock is mounted on a stand 18 which serves to position the clock so that the sun's path, at spring and fall equinox, is in a plane P perpindicular to the clock axis A.

Figure 2:
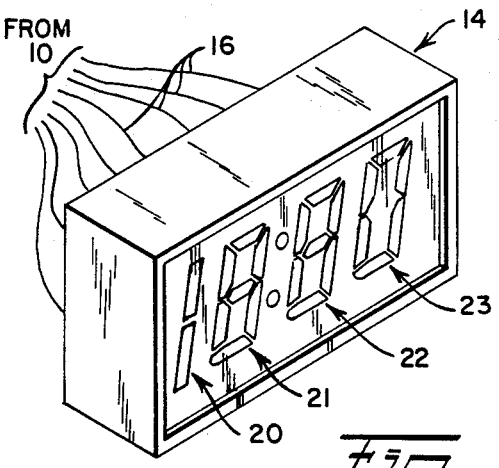
FIG. 2 is a perspective view of a digital time display.

As shown in FIG. 2, digital display means 14 comprises four numeric displays 20, 21, 22 and 23, each comprising a plurality of glass or plastic elements which are adapted to be illuminated by solar energy piped thereto by light guides 16. In the conventional manner, numeric displays 20 and 21 display tens of hours and unit hours, respectively, and numeric displays 22 and 23 display tens of minutes and unit minutes, respectively. Preferably, each of the inboard numeric displays 21 and 22 is of the so-called "seven-segment" variety which can selectively display any number from zero to nine, depending on which of its respective seven elements or "segments" are illuminated. As will be seen, however, the numeric display 23 need only display the digit "zero" in order for the display means 14 to display the solar time with an accuracy of plus or minus five minutes, an accuracy quite acceptable for most users of solar time pieces. Also, numeric display 20 need only display the number "1" between 10:00 AM and 12:59 PM. Hence, neither display 20 or 23 need be of the seven-segment variety; rather, display 20 may have only two elements, and display 23 have only six elements, as shown. Alternatively, the digit "1" of display 20 may be a single, more elongated element, and the digit "0" of display 23 may be constructed by a single substantially circular element. Owing to the light-transmitting efficiency of conventional optical fibers, the display can be located at virtually any distance from time-detecting components.

Figure 8:
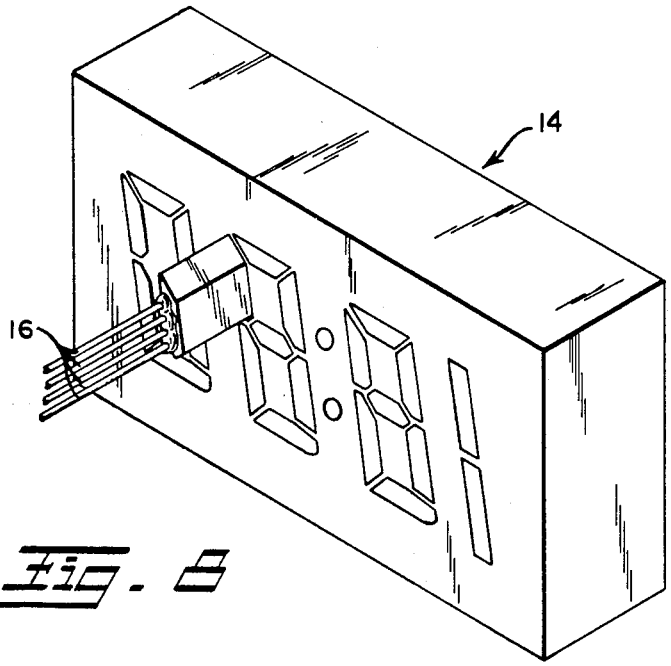
FIGS. 7 and 8 illustrate the coupling between light guides and digital display.
Figure 7:
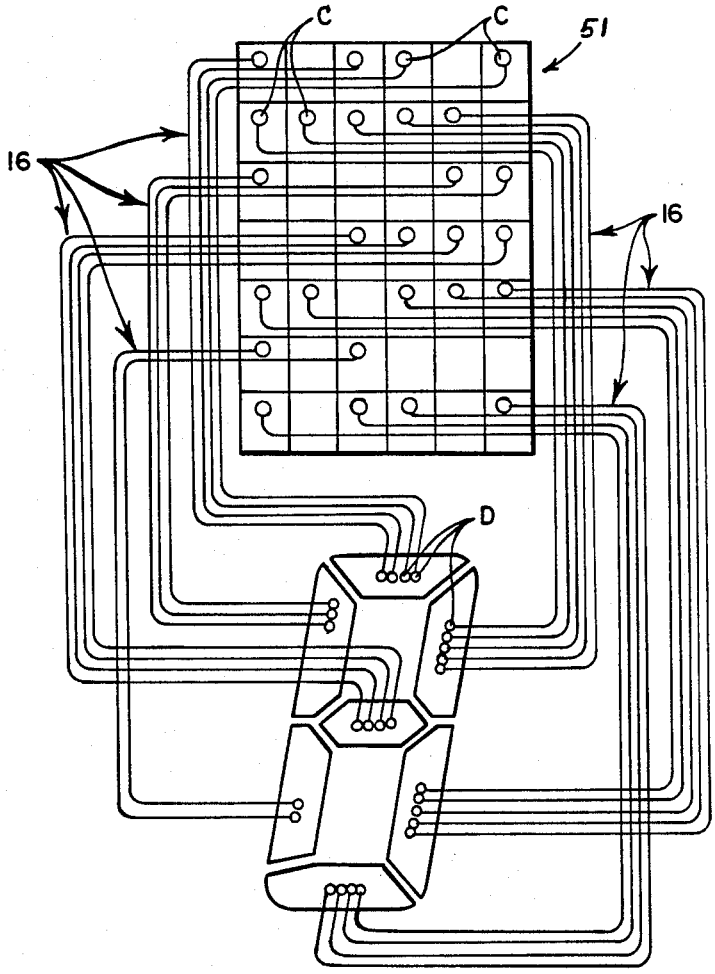

As shown in FIGS. 7 and 8, each of the optical light guides P has a light-collecting end C arranged to be irradiated by solar radiation transmitted by the mask member, and a remote light-discharging end D which is optically coupled (e.g. with a transparent epoxy) to the illuminable elements comprising the numeric displays. The light-collecting ends are arranged to form a plurality of linear arrays which, as explained below, are strategically positioned with respect to the mask member so that each array is irradiated at the appropriate time of day so that the correct solar time will be displayed.

Figure 3:
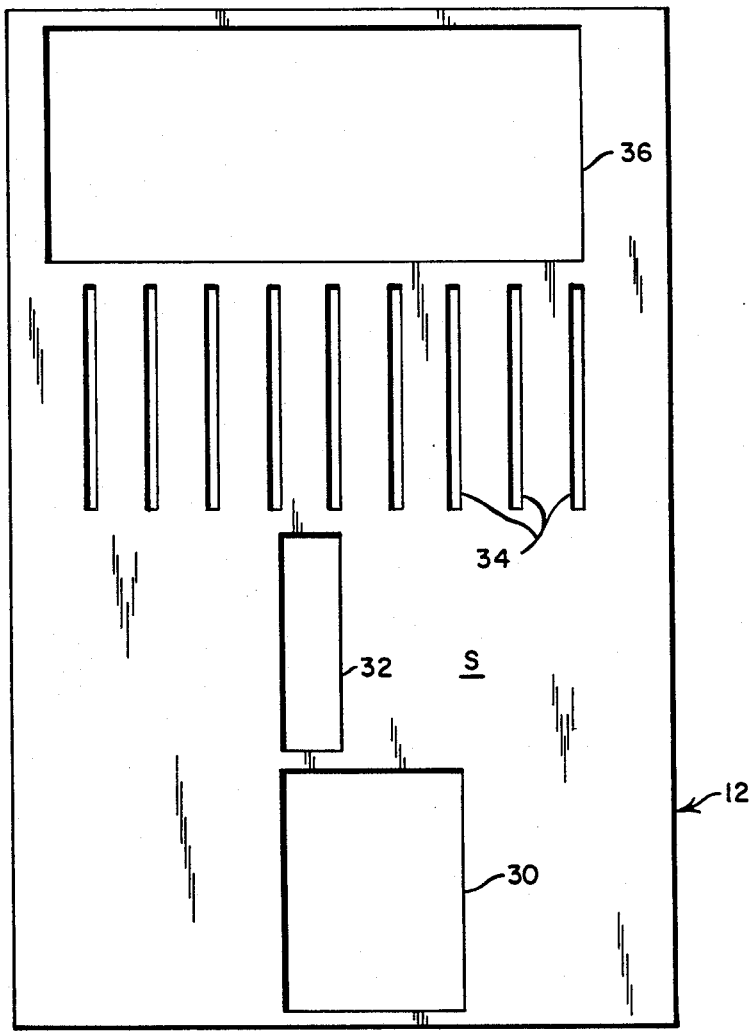
FIG. 3 is a top plan view of an unrolled mask member forming part of the invention.
Figure 4:
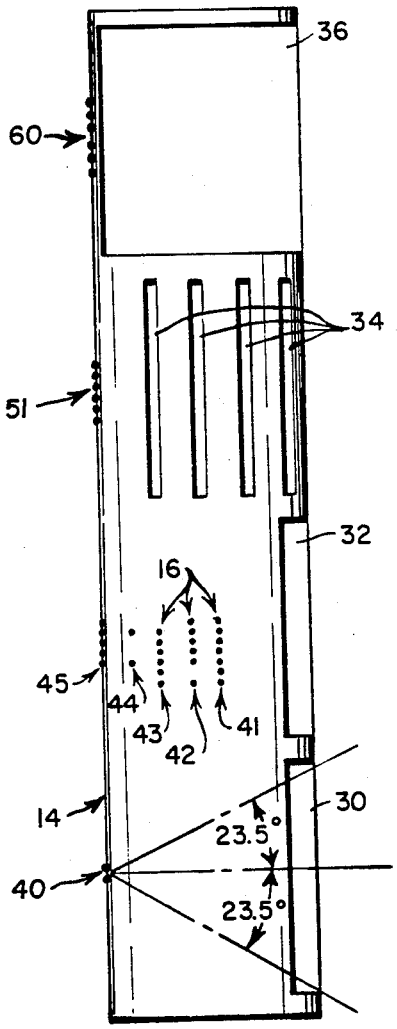
FIGS. 4 and 5 are side and front views of the FIG. 3 mask member configured as used in the preferred embodiment.
Figure 5:
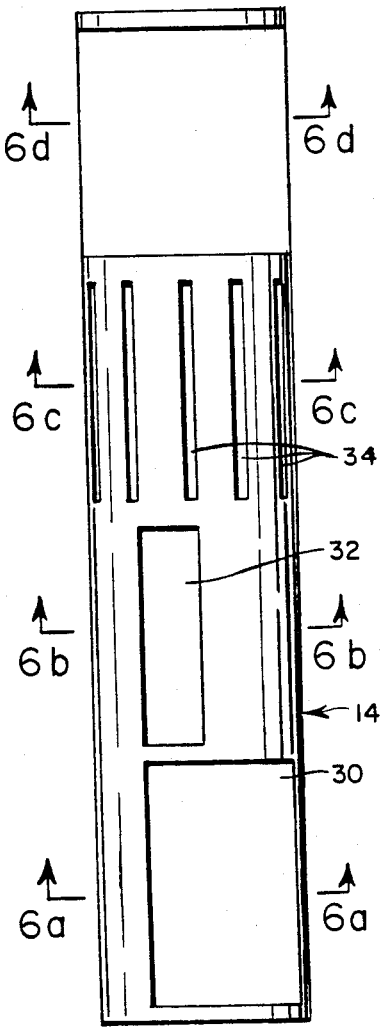

Referring to FIGS. 3–5, mask member 12 preferably comprises a flexible rectangular sheet S, made of any opaque material, having a plurality of rectangular apertures 30, 32, 34 and 36 formed therein. In use, the sheet is curled to form a right-circular cylinder, as shown in FIGS. 1, 4 and 5 and small linear arrays of holes are strategically located in the sheet to support the light-collecting ends of the light guides. Alternatively, the mask member may be a cylinder of clear plastic (e.g., Plexiglas or the like) which is covered with an opaque coating in which the apertures are formed (i.e., by leaving areas uncoated on the plastic). Apertures 30 and 32 cooperate with different light guide arrays to display tens of hours and unit hours, respectively. In a similar fashion, apertures 34 and 36 cooperate with other light guide arrays to display tens of minutes and unit minutes, respectively. The cooperation between mask member 12 and the light guide arrays will be better understood from the cross-sectional views of FIGS. 6A–6D, discussed below.

Figure 6A:
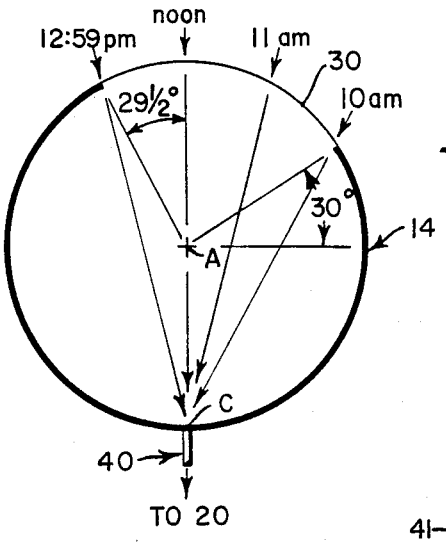
FIGS. 6A–6D are cross-section illustrations of the mask member shown in FIG. 5 taken along the section lines A—A, B—B, C—C and D—D, respectively.

Referring to FIG. 6A, aperture 30 cooperates with a first pair of light guides 40 (only one guide being shown in FIG. 6A, the other being hidden from view, directly beneath the one shown) to display the digit "1" in the tens-of-hours of the digital display. Aperture 30 is of such size that, as the sun sweeps across the sky, from right to left in the drawings, the sun will illuminate the light-collecting ends C of the two light guides during the time interval from 10:00 AM to 12:59 PM. Outside this time interval, the mask will block the sun and thereby prevent the sun from illuminating those light guides responsible for illuminating the tens of hours numeric display 20.

As shown in FIG. 4, the length of aperture 30, measured in a direction parallel to axis A, is sufficient to give the light-collecting ends of the light-guides a field of view of approximately + or −23.5 degrees, the tilt of the earth's axis of rotation from winter to summer solstace. In fact, all apertures of mask member 12 are of sufficient length to permit irradiation of the light guides in spite of the variation in the sun's declination at different times of the year.

In order for the digital display means to display the correct unit hours between 8:00 AM and 4:59 PM, numeric display 21 must sequentially display the digits 8, 9, 0, 1, 2, 1, 2, 3 and 4, changing, of course, each hour. This sequential display is achieved by the combination of the relatively narrow aperture 32, and a total of nine linear light guide arrays 41–49, shown in FIG. 6B. Whereas aperture 30 is precisely 2 hours and 59 minutes wide, (i.e., the sun will illuminate the light guide array 40 for this period of time through such aperture), aperture 32 is only one hour wide, i.e., the sun will illuminate each of the arrays 41–49, one at a time, for a one hour period through aperture 32. Preferably, each of the light guide arrays is supported at an angle relative to the normal to the cylindrical mask member at the location so that the sun, when it illuminates a particular array, is incident approximately normal to the light guide ends C. This geometry maximizes the light-gathering effeciency of the light guides.

Figure 10:
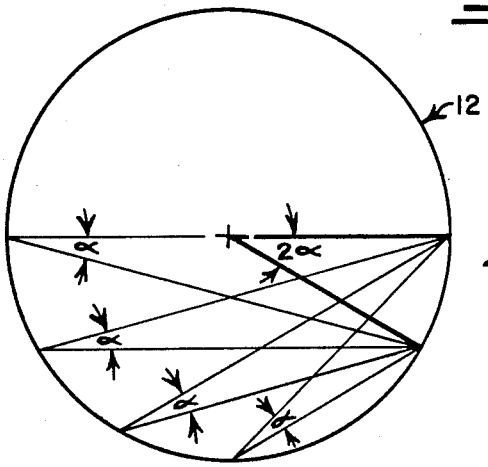
FIG. 10 illustrates the geometrical relationships of a circle, relationships which determine the size and positions of apertures in the mask member of FIG. 3.

As regards the number of light guides in each of the arrays 41–49, each array has a number determined by the number of elements of the numeric display 21 which must be illuminated to display the the correct unit hour. For example, as the sun passes in a counter-clockwise direction past aperture 32, light guide array 41 is first illuminated for the one hour period from 8:00 to 8:59 AM. Thus array 41 must cause the digit "8" to be displayed by numeric display 21. To display the digit "8", all of the seven elements comprising the seven-segment display 21 must be illuminated. Thus, array 41 must comprise at least seven light guides, each having its light-discharging end D coupled to a different one of the seven display elements which must be illuminated during the 8:00–8:59 time period. Obviously, each array may have two or more light guides optically coupled to each display element if a greater illumination is desired. Assuming, however, that one light guide per element is sufficient, as is the case, then array 42 need only comprise six light guides to display the digit "9"; array 43 need comprise six guides to display "0"; array 44 need comprise only two guides to display "1"; array 45 need comprise five guides to display "2"; etc. From the above, it will be apparent that arrays 46–49 need comprise two, five, five and four elements, respectively. Obviously, all of the light collecting ends of the light guides in a given array should be linearly aligned, parallel to axis A, so that they are all illuminated simultaneously by solar energy. Also, each array is equally spaced from adjacent arrays, each array being spaced by an arc of 15 degrees from its neighbors, as measured from the leading edge of opening 32. This geometry is determined by the fact that the sun moves through an arc of almost precisely one-quarter degree every minute, or 15 degrees every hour. Thus, it will be appreciated that aperture 32 must be 15 degrees in arc width, as measured from the end of any light guide, or 30 degrees as measured from axis A due to the geometry of a circle, as shown in FIG. 10. By the geometry described, it will be seen that, as the sun begins to be blocked from illuminating one array, it begins to illuminate the adjacent array, determined in a "counter-clockwise" direction, as viewed in FIGS. *6b*.

Figure 9:
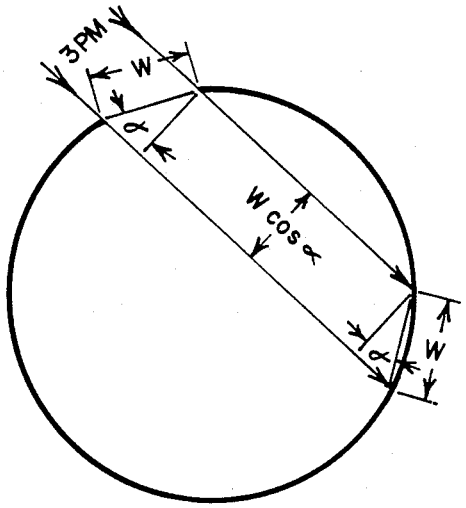
FIG. 9 illustrates certain geometrical relationships in the mask member comprising the preferred embodiment.
Figure 6B:
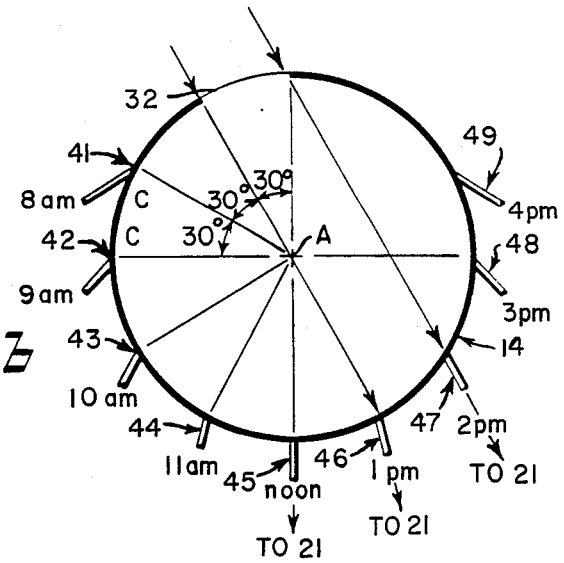
Figure 6C:
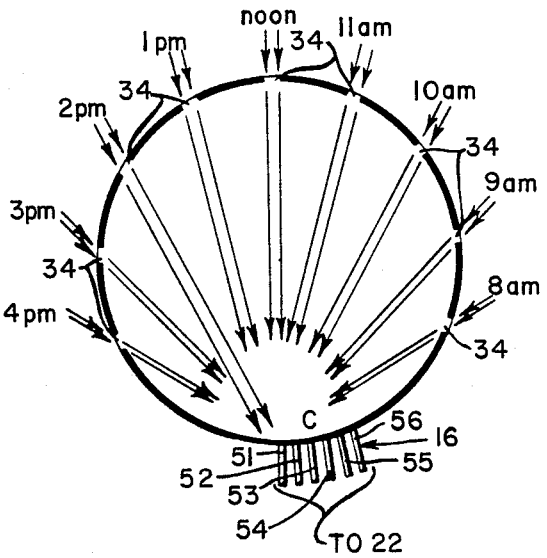

In a somewhat similar manner, nine apertures 34 cooperate with six different light guide arrays 51–56 to display tens of minutes on the numeric display 22. Referring to FIGS. 3, 6C and 7, mask member 12 is shown to comprise nine spaced apertures 34 which are spaced 30 degrees apart, measured from axis A. On the far wall of mask member 12 are the six linear arrays 51–56. Each array is spaced from its adjacent array by 5.0 degrees, measured at axis A. As the sun tracks counter-clockwise about the mask member, the narrow band of light passing through the 8 AM aperture 34 begins to illuminate array 51. As shown in FIG. 7, array 51 comprises six light guides 16 which are optically coupled to the seven-segment numeric display 22 so that, when array 51 is illuminated, it causes the digit "0" to appear on the display. This digit will appear for ten minutes, the time required for the sun to traverse 2.5 degrees of arc, the angular width of apertures 34, as measured from the leading edges of apertures 34 (or 5.0 degrees measured from axis A). After ten minutes, light passing through the 8 AM aperture 34 will begin to illuminate array 52, and the digit "1" will be displayed for ten more minutes on display 22. As shown in FIG. 7, array 52 need only comprise two light guides in order to display the digit "1". After ten more minutes, array 53 is illuminated, and so on until all arrays 51–56 have been illuminated by the 8 AM aperture 34. This process takes precisely one hour to complete, after which the 8 AM aperture no longer allows sunlight to illuminate the arrays 51–56. At this point, however, the 9 AM aperture 34 begins to sequentially illuminate arrays 51–56 for the next hour. This process is continued throughout the day until the 4 PM aperture 34 has illuminated array 56. Note, since the sun light irradiating the arrays is, in effect, collimated, the spacing between the arrays 51–56 is equal to the width of the aperture 34. Similarly, as shown in FIG. 6B, arrays 41–49 are spaced equal to the width of aperture 32. Note, too, that as the position of the sun changes, (i.e. an angle $\alpha$ varies in FIG. 9), the width of the shaft of sunlight inside the mask member is increasingly pinched off and its width is $\omega \cos \alpha$. In spite of this narrowing of the shaft of light, it strikes the inside of the mask at an angle $\alpha$, equal to the entrance angle $\alpha$, it produces a patch of illumination on the interior of the mask equal to the width of the aperture. This geometry assures that each array, for example, of the unit-hours section is illuminated for the same time period, regardless of the angle of incidence of the sunlight.

The number of light guides in each of the arrays 51–56, and the manner in which they are optically coupled to the different elements of numeric display 22 is shown in FIGS. 7 and 8. Arrays 41–49, discussed above, are similarly coupled to the seven elements of numeric display 21 to illuminate the appropriate elements at the appropriate time. It will be appreciated that the vertical order of the light guides is arbitrary, whereas the horizontal order is sequential, left to right, as viewed in the drawings.

Figure 6D:
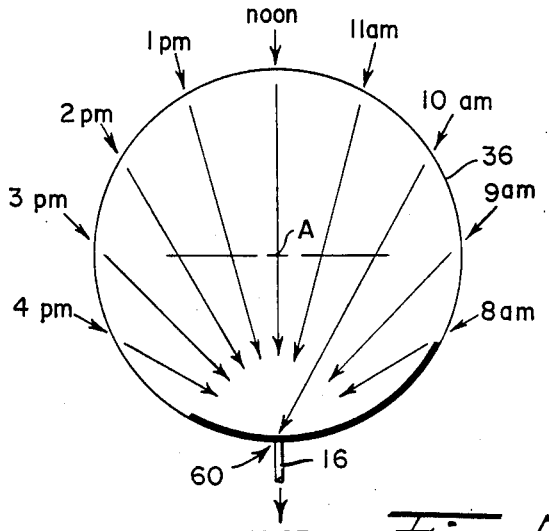

Referring finally to FIG. 6D, we see that aperture 36 has an arc width of 270 degrees, measured from axis A. This aperture cooperates with a single light guide array 60 to display the digit "0" on numeric display 23 at all times, i.e., between the hours 8:00 AM and 4:59 PM, the operating hours of the clock. Array 60, of course, comprises six light guides, one for each of the elements of display 23 that need be illuminated to display "0". The relatively large aperture 36 (270 degrees) is required so that the sun may illuminate the array during the 135 degree counter-clockwise movement of the sun during the nominal 9 hour time period in which the clock is operable each day. Note, it is physically impossible to display time with any sun-dial with an accuracy of unit minutes. The reason is that the sun is not a point source; rather, it subtends an arc of about one-half degree, the equivalent motion of the sun for two temporal minutes. Thus, it would be theoretically possible to devise a mask/detector scheme, in accordance with the present invention, to change the unit-minutes display for a period of time of just over two minutes.

Various means may be provided for enhancing the contrast between sunlight-illuminated numeric display elements and those illuminated by the spurious skylight which enters the interior of the mask member through the different apertures. For example, a warm-colored filter e.g., a red, orange or yellow filter, may be introduced anywhere in the optical path between the sun and the display. Such a filter would selectively absorb the blue skylight while passing the yellow-red wavelengths of the sunlight. Similarly, a suitably oriented polarizing filter can be used at the collecting ends of the light guides. Also, three circular opaque light baffles, preferably matte black to absorb stray light, can be added to the interior of the cylindrical mask member to prevent, for example, the light entering the mask interior through aperture 34, intended for the tens-of-minutes arrays, from illuminating the unit-minutes or unit-hours arrays. Thus, the interior of the mask member may be divided into four compartments, one for each numeric display.

As shown in FIG. 10, the geometry of a circle is such that it provides a 2:1 relationship when measuring the angle subtended by any circular portion of the perimeter when comparing the vertex at the center of the circle to the vertex at the perimeter of the circle, but such vertex not contained within the arc shape being measured. Thus, on a circular clock face, for example, each hour marking is 30 degrees from its neighbor, as measured from the center of the dial. However, that same spacing is only 15 degrees apart if measured from any point on the far side of the dial.

To display the correct solar time during the period of "daylight-saving", means are provided for manually rotating the mask member (and the light guide arrays it supports) by 15 degrees, measured again at axis A. A locking pin 70 serves to lock the mask member relative to its support 20 in either of two positions, rotatably spaced by 15 degrees.

While the invention has been described with reference to a preferred embodiment, various modifications can be made without departing from the spirit of the invention. It will be appreciated that the sun clock disclosed herein is, in a broad sense, an optical analog-to-digital converter, i.e., it converts the analog position of a moving light source to a digital form. While the digital display has been configured to yield human-readable numerals displaying the time of day, it could be configured to provide the angular position of the sun in numerical form. Such modifications are intended to be within the scope of the following claims.

I claim:

1. A solar clock comprising:

(a) an opaque mask member having a plurality of spaced apertures therein adapted to transmit solar energy;

(b) a plurality of optical fiber light guides adapted to receive light at a first end and transmit such received light to a second end where the light is discharged, said first ends being arranged to form a plurality of linear arrays;

(c) means for supporting said light guides so that said arrays are arranged in predetermined positions relative to said apertures to be illuminated by solar radiation passing through certain of said apertures at predetermined times of day; and (d) digital display means comprising a plurality of spaced, selectively illuminable elements, each of said elements being optically coupled to one or more of the respective second ends of said light guides for displaying, in digital form, the solar time.

2. The solar clock as defined by claim 1 wherein said mask member comprises a cylindrical tube in which said apertures are formed, and wherein said support means supports said arrays on the surface of said tube.

3. The solar clock as defined by claim 1 wherein said linear arrays are arranged with respect to said apertures so that each of the first ends of each array, when irradiated by solar radiation passing through an aperture, are irradiated simultaneously.

4. The solar clock as defined by claim 1 wherein said digital display means comprises means for displaying, at different positions, tens of hours, unit hours, and tens of minutes, and wherein said mask member has (a) a first aperture which cooperates with a first array of light guide ends for optically coupling solar radiation to said display means to display, in the tens-of-hours position, the number 1 during the time interval from 10:00 AM to 12:59 PM; (b) a second aperture which cooperates with a plurality of equally spaced arrays of light-guide ends for sequentially displaying, in the unit hours position, the numbers 8,9 0,1,2,1,2,3 and 4 during the time interval from 8:00 AM to 4:00 PM; and (c) a plurality of equally spaced third apertures of equal size which cooperate with a plurality of equally spaced third arrays of light-guide ends for sequentially and repeatedly displaying each hour, in the tens-of-minutes position the numbers 0,1,2,3,4 and 5.

5. The solar clock as defined by claim 4 wherein said mask member further comprises a fourth aperture which cooperates with a fourth array of light-guide ends for continuously displaying, in the unit-minutes position, the number 0.

6. The solar clock as defined by claim 1 wherein said solar display means is illuminated by solar radiation.

7. A solar clock comprising a digital display including a plurality of multiple-segment numeric displays, at least two of said numeric displays being adapted to selectively display a plurality of different numeric characters, each of said numeric displays comprising a plurality of light-responsive segments which, when operatively coupled to light, becomes more visible than before such coupling, and means for selectively coupling sunlight to said segments in such a manner that said digital display displays the solar time.

8. The solar clock as defined by claim 7 wherein said coupling means comprises an opaque-mask member having a plurality of spaced, light-transmitting apertures of predetermined size, shape and relative position, means for supporting said mask member, to be directly irradiated by solar radiation, and a plurality of optical light guides positioned to be irradiated by solar radiation transmitted by said apertures for coupling such radiation to the light-responsive elements of said numeric displays.

9. The solar clock as defined by claim 8 wherein said mask member has a cylindrical shape with a circular cross-section, such cylindrical geometry providing uniform and correct illumination of the light-guide ends regardless of the inclination of the sun or the time of day.

10. Optical analog-to-digital conversion apparatus for displaying the analog position of a moving source of radiation in digital form, said apparatus comprising:

(a) an opaque mask member having a plurality of spaced apertures therein adapted to transmit radiation from such source;

(b) a plurality of optical fiber light guides, each guide being adapted to receive radiation at a first end and transmit such received radiation to a second end where the radiation is discharged, said first ends being arranged to form a plurality of linear arrays;

(c) means for supporting said light guides so that said arrays are arranged in predetermined positions relative to said apertures to be illuminated by radiation passing through certain of said apertures at predetermined times during movement of the radiation source; and (d) digital display means comprising a plurality of spaced, selectively illuminable elements, each of said elements being optically coupled to one or more of the respective second ends of said light guides for displaying, in digital form, the instantaneous position of the source.

* * * * *